US006561357B2

(12) United States Patent
Renck

(10) Patent No.: US 6,561,357 B2
(45) Date of Patent: May 13, 2003

(54) SINGLE-PIECE FOLD-TO-SHAPE PROTECTIVE DEVICE

(75) Inventor: Lawrence E. Renck, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/882,004

(22) Filed: Jun. 15, 2001

(65) Prior Publication Data

US 2002/0189969 A1 Dec. 19, 2002

(51) Int. Cl.[7] ..... B65D 81/05
(52) U.S. Cl. ..... 206/586; 206/320; 428/34.2
(58) Field of Search ..... 206/320, 453, 206/586, 591, 594; 428/34.2, 36.9, 36.91, 121; 402/73

(56) References Cited

U.S. PATENT DOCUMENTS

| | | | | | |
|---|---|---|---|---|---|
| 1,852,832 | A | | 4/1932 | Beaman | |
| 2,196,157 | A | | 4/1940 | White | |
| 2,476,197 | A | | 7/1949 | Kincaid | |
| 2,878,982 | A | | 3/1959 | Gariepy | |
| 3,126,144 | A | | 3/1964 | McCulloch | |
| 3,613,985 | A | * | 10/1971 | Goodsite | 206/586 |
| 3,653,496 | A | | 4/1972 | Roberts et al. | |
| 3,734,389 | A | * | 5/1973 | Brown | 206/586 |
| 3,957,196 | A | | 5/1976 | Kellerman | |
| 3,982,682 | A | * | 9/1976 | Fremion | 206/586 |
| 4,027,817 | A | | 6/1977 | Fremion | |
| 4,202,449 | A | | 5/1980 | Bendt | |
| 4,248,350 | A | * | 2/1981 | Gilbert | 206/586 |
| 4,482,054 | A | * | 11/1984 | Gardner | 206/586 |
| 4,771,893 | A | | 9/1988 | Liebel | |
| 4,784,270 | A | | 11/1988 | Layer et al. | |
| 5,813,537 | A | | 9/1998 | DeReu et al. | |
| 5,971,650 | A | * | 10/1999 | Dottel | 402/73 |
| 6,209,917 | B1 | * | 4/2001 | Welch | 402/73 |
| 6,298,526 | B1 | * | 10/2001 | Baumdickler et al. | 24/559 |

* cited by examiner

*Primary Examiner*—Jim Foster
(74) *Attorney, Agent, or Firm*—Bullwinkel Partners, Ltd.

(57) ABSTRACT

A single piece protective device that can be stacked or nested in an unfolded position and then folded into the desired shape when ready for use is provided. The device is made from a substantially rectangular sheet of laminated paperboard. The sheet comprises an outer wall and an inner wall connected by a hinged area running longitudinally from top to the bottom. The hinged area comprises a plurality of longitudinal creases or scores. The sheet is made of multiple plies of material laminated together. The plies can be made from different types of materials, and may be oriented in different directions to achieve desired structural properties. The unfolded sheets are nestable for efficient storage and shipping.

24 Claims, 7 Drawing Sheets

SINGLE-PIECE FOLD-TO-SHAPE PROTECTIVE DEVICE

BACKGROUND

1. Field of the Invention

This patent relates to a device for protecting items such as household appliances from damage during shipping and handling. More specifically, this patent relates to a protective device formed from a single piece of laminated paperboard that can be folded into a hollow tubular shape when ready to be used.

2. Description of the Related Art

Protective devices consisting essentially of paper tubes are used to support and cushion the corners of large appliances (such as washers, dryers and the like) during storage and transport. Conventional protective devices, such as the highly successful Sonopost® protective device, typically are formed from two or more plies of convolutely wound laminated paperboard formed into a protective shape on a mandrel and then dried into the finished shaped tubular form.

A disadvantage such of conventional convolutely wound protective devices is that they can only be made from a single type of paperboard, since the paperboard is fed from a single roll onto the mandrel. This disadvantage was addressed in Qiu U.S. Pat. No. 6,186,329, commonly owned with this invention, which describes a support post made of multiple sheets of paperboard joined together edge-to-edge to form a roll. The roll is then convolutely wound onto a mandrel, formed, and dried to produce a hollow tubular protective post. The protective post can be made from more than one type of paper, or from paper having different orientations, or from cross-laminated paper.

However, the finished product is a hollow tubular protective that takes up as much room during shipping and storing as conventional convolutely wound protective devices. There exists a need for a protective device that can made from more than one type of paper, or from paper having different orientations, or from cross-laminated paper, but can be shipped and stored in a substantially flat configuration and then folded to shape when ready to use.

Thus, it is an object of the present invention to provide a single piece protective post that can be stacked or nested in an unfolded position and then folded into the desired shape when ready for use.

Another object of the present invention is to provide a single piece protective post that can be made from more than one type of paper.

Yet another object of the present invention is to provide a protective post that can be made from paper layered in different orientations.

Further and additional objects will appear from the description, accompanying drawings, and appended claims.

SUMMARY OF THE INVENTION

The present invention is a single piece protective device that can be stacked or nested in an unfolded position and then folded into the desired shape when ready for use. The device is made from a substantially rectangular sheet of laminated paperboard. The sheet comprises a hinged area running longitudinally from top to the bottom, an outer wall portion extending from the hinged area and terminating in a connecting portion, and an inner wall portion extending from the hinged area away from the outer wall portion and terminating in another connecting portion.

Preferably, the hinged area comprises a plurality of longitudinal creases. Each crease can extend the entire height of the sheet or less than the entire height of the sheet. In the latter instance, the creases may be staggered. The hinged area may comprise smooth, uncreased horizontal sections disposed between the staggered creases.

The sheet is made of multiple plies of material laminated together. The plies can be made from different types of paperboard, may be oriented in different directions, or may be cross-laminated to achieve desired structural properties.

The protective device may be L-shaped to protect the corner of a packaged article or I-shaped to protect the side walls of an article. In either case the unfolded sheets are nestable for efficient storage and shipping.

When folded to form the finished protective device, the connecting portions may form a snap fit. Alternatively, the connecting portions may be glued, stitched or stapled together. The walls may have integrally formed beads or grooves for added strength.

THE DRAWINGS

DETAILED DESCRIPTION OF THE INVENTION

Figure 1:
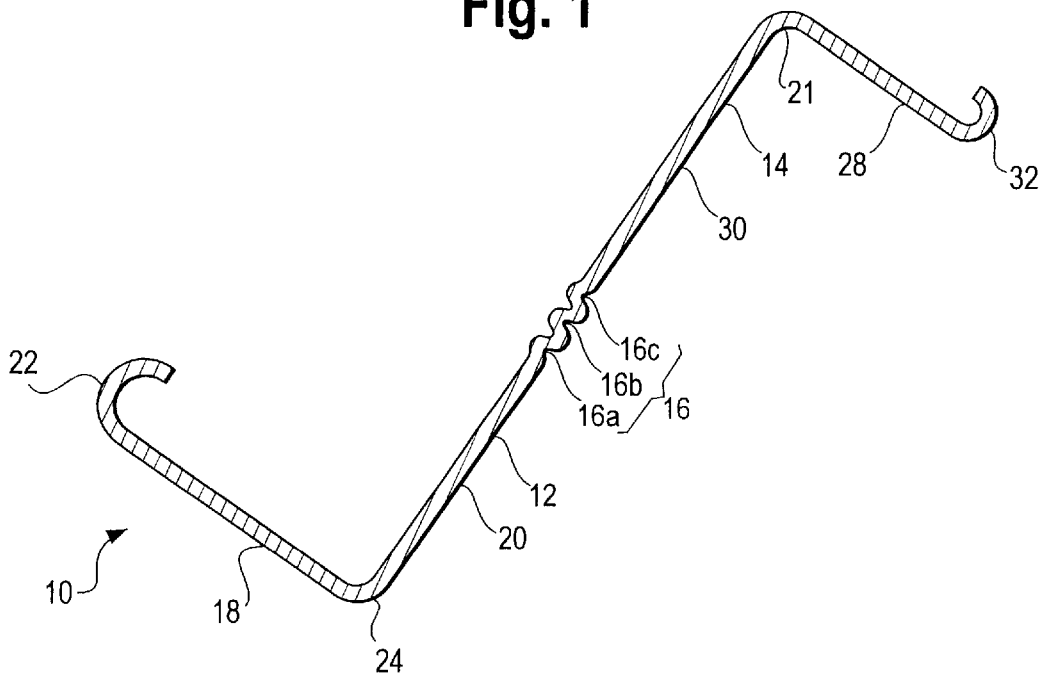
FIG. 1 is a top plan view of a protective post according to the present invention in an unfolded position.

Turning to the drawings, there is shown in FIG. 1 one embodiment of the present invention, a protective device 10 used for cushioning and protecting packaged articles such as large appliances. The protective device 10 is placed between the product and the packaging walls to provide protection from both axial (vertical) and transverse (horizontal) forces.

Figure 2:
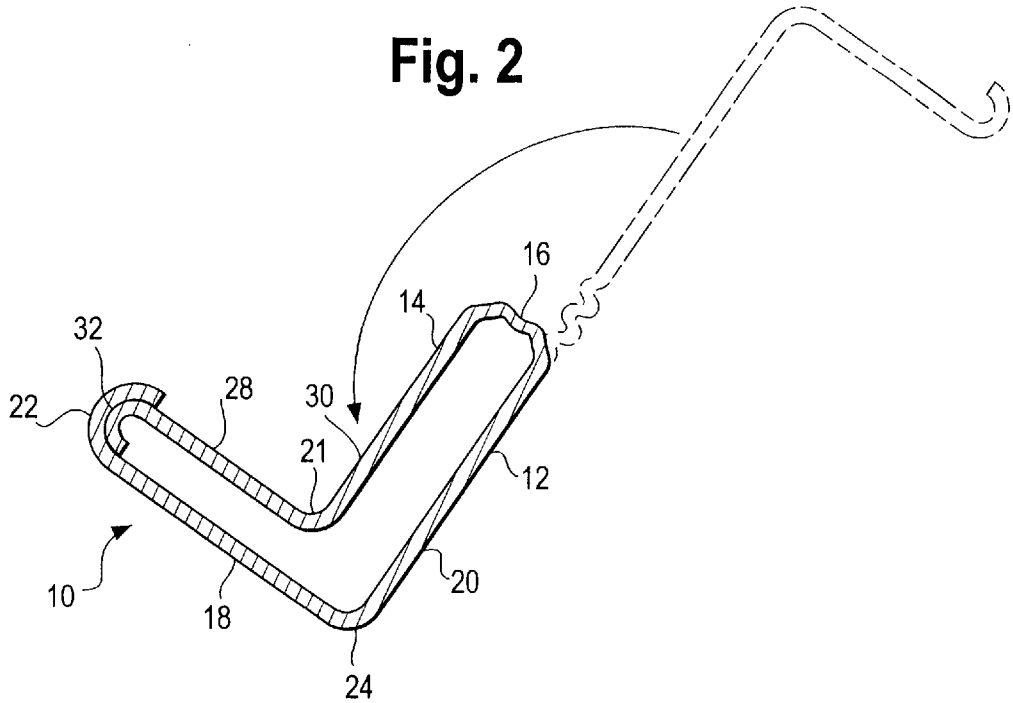
FIG. 2 is a top plan view of the protective post of FIG. 1 after it has been folded into shape.
Figure 3:
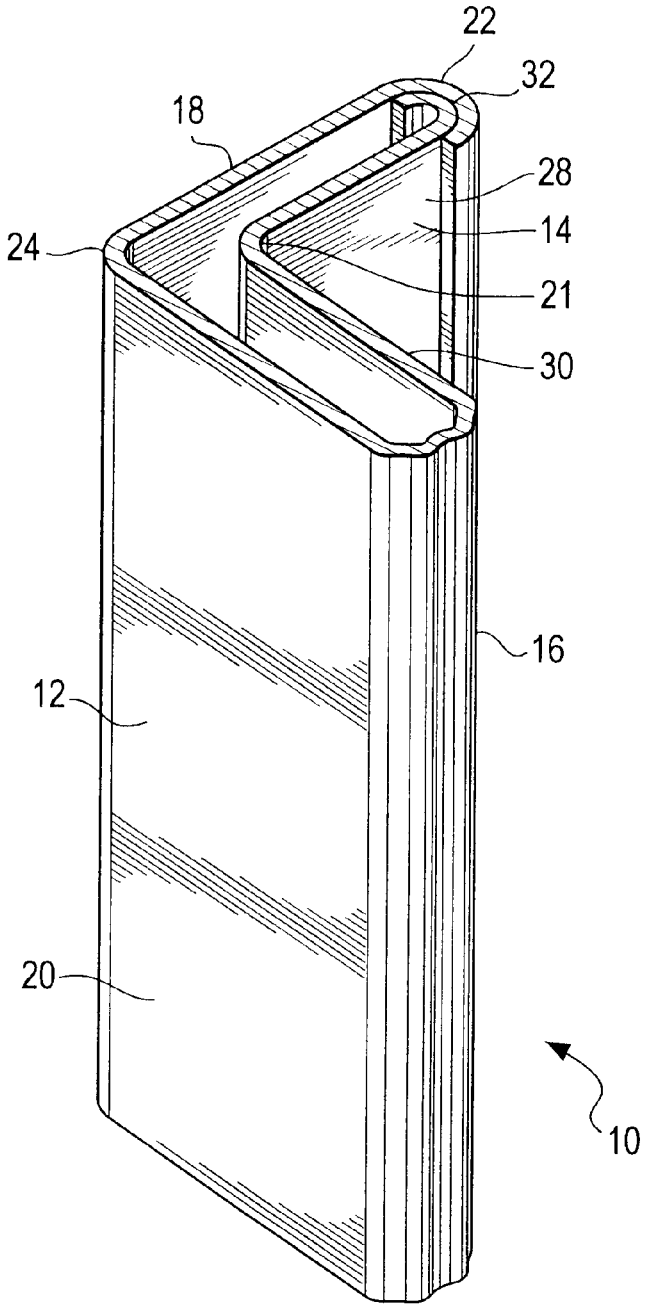
FIG. 3 is a perspective view of the protective post of FIG. 2.

In the embodiment shown in FIGS. 1–3, the protective device 10 comprises an outer wall portion 12 and an inner wall portion 14 connected by a hinged area 16. As shown in FIG. 2, one or both of the wall portions 12, 14 can be rotated with respect to the hinged area 16 to form the hollow L-shaped tube 10 shown in FIGS. 2 and 3.

The outer wall portion 12 comprises first and second legs 18, 20 connected at an outer wall apex 24 and forming a substantially right angle. The first leg 18 terminates in a hook or connecting portion 22. The second leg 20 terminates at the hinged area 16.

The inner wall portion 14 comprises first and second legs 28, 30 connected along an inner corner 21 and forming a substantially right angle. The inner legs 28, 30 correspond to the first and second outer legs 18, 20 such that, if the inner wall portion 14 is rotated counterclockwise (viewed from above) around the hinged area 16 to form the tubular corner post 10 of FIG. 2, the first inner leg 28 is parallel to the first outer leg 18, and the second inner leg 30 is parallel to the second outer leg 20.

Like the first inner leg 18, the first outer leg 28 terminates in a hook or connecting portion 32. The connecting portions may be curved, as shown in the figures, squared, or any other suitable configuration such that, when the wall portions 12, 14 are brought together, the connecting portions 22, 32 cooperate to form a close fit. If the connecting portions are curved as shown in the figures, the outer connecting portion 22 may define an arc slightly greater than 180 degrees so that the end portions snap together, although this will have an adverse effect on nestability.

Instead of, or in addition to, the snap fit, the connecting portions 22, 32 may be joined by adhesive, staples, stitches or any other suitable means to form the finished protective device 10 shown in FIG. 3. Because the connecting portions 22, 32 overlap as shown in FIGS. 2 and 3, that area of the protective device is stronger than the same area in a conventional wound protective device.

Preferably, the hinged area 16 comprises three longitudinal creases 16*a*, 16*b*, 16*c* running longitudinally from top to bottom as shown in FIG. 1, although any suitable number of creases may be used. For example, the hinged area 16 may be made with two creases, each crease defining a ninety-degree angle when the device is folded.

When the walls 12, 14 are brought together into alignment, the creased areas 16*a*, 16*b*, 16*c* form a 180 degree curve, as shown in FIGS. 2 and 3. It is important that this curve be as smooth as possible to maintain the integrity of the protective device, especially with regard to resistance to axial and transverse forces.

The width and depth of the creases 16*a*, 16*b*, 16*c* and the distance between the creases 16*a*, 16*b*, 16*c* can be varied depending on the desired properties, such as bending resistance, and the desired distance between the walls 12, 14 in the finished device 10. For example, three or four creases spaced ¼ to ⅜ inches apart can provide a protective device 10 in which the outer and inner walls are one-half to one inch apart.

Figure 11:
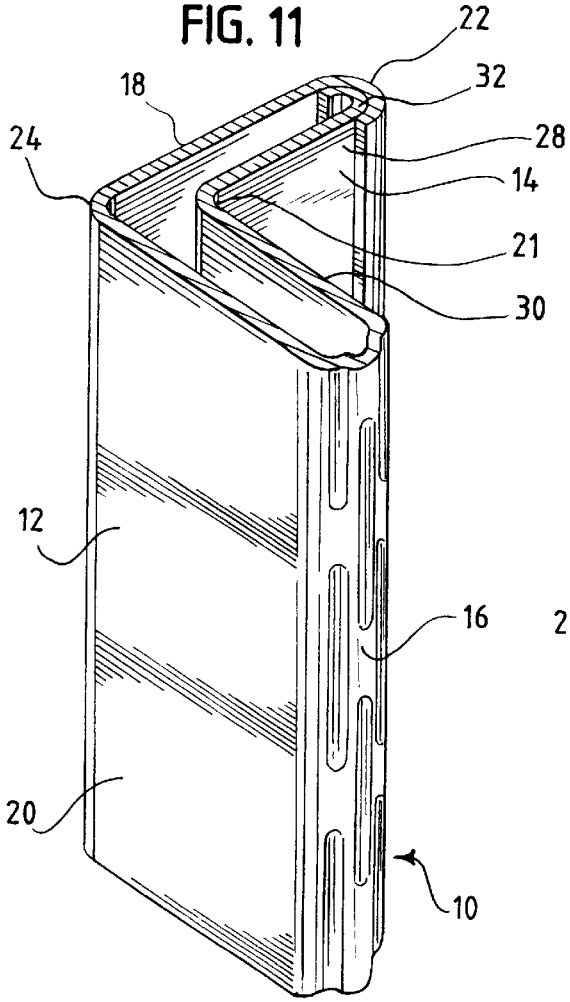
FIG. 11 is a perspective view of a protective post according to the present invention with staggered creases along the hinged area.
Figure 12:
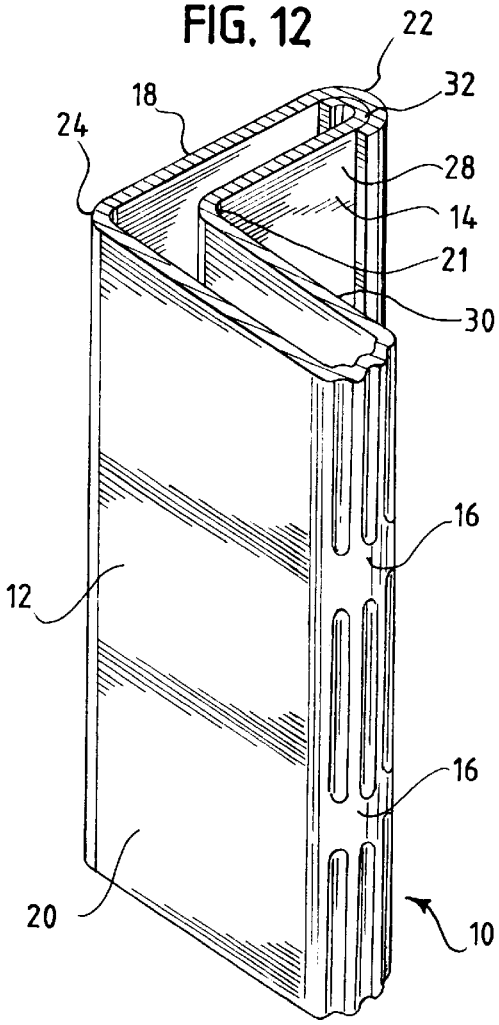
FIG. 12 is a perspective view of a protective post according to the present invention having a hinged area having uncreased horizontal sections disposed between creases.

The creases may run the entire vertical length of the protective device or less than the entire length. In the latter case, the creases may staggered, as shown in FIG. 11. The staggered creases may overlap (FIG. 11) or there may be little horizontal areas that are not creased (FIG. 12). Horizontal areas that are not creased will strengthen the protective device 10 by leaving the paperboard fibers in those areas unbroken. Thus, when lifting or carrying the unfolded protective device 10, the non-creased areas will tend to support the device 10 and prevent premature bending of the device 10 along the hinged area 16.

Preferably, the paperboard fibers run substantially longitudinally (vertically). This makes it is easier to bend the device 10 along the hinged area 16. The less the fibers are oriented longitudinally, the harder the device will be to bend, and the more necessary it becomes to crease or score the hinged area 16.

Creasing the hinged area 16 will result in slight indentations on the creased side of the wall. Depending on the depth of the indentations and the tool used to make the indentations, there may be slight raised areas on the opposite side.

Figure 13:
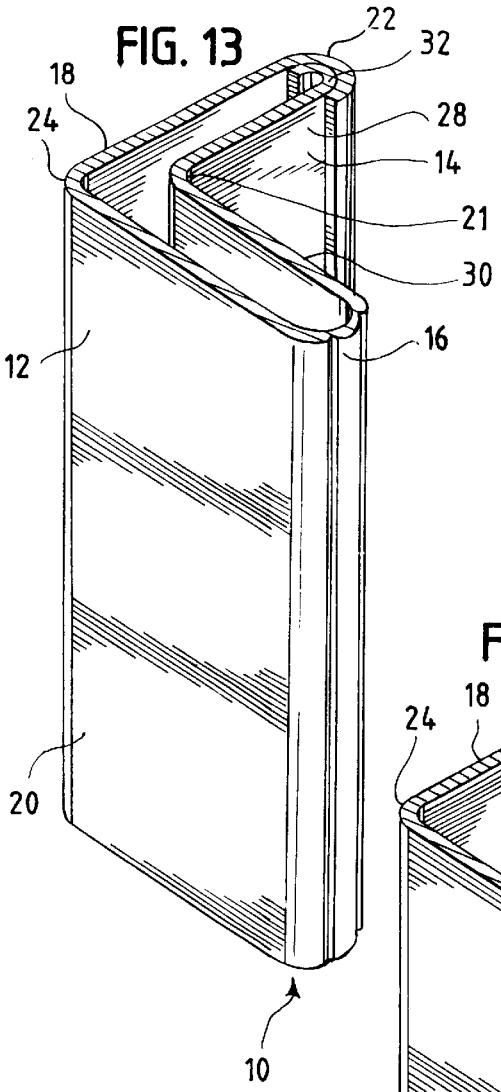
FIG. 13 is a perspective view of a protective post according to the present invention having score lines along the hinged area.
Figure 15:
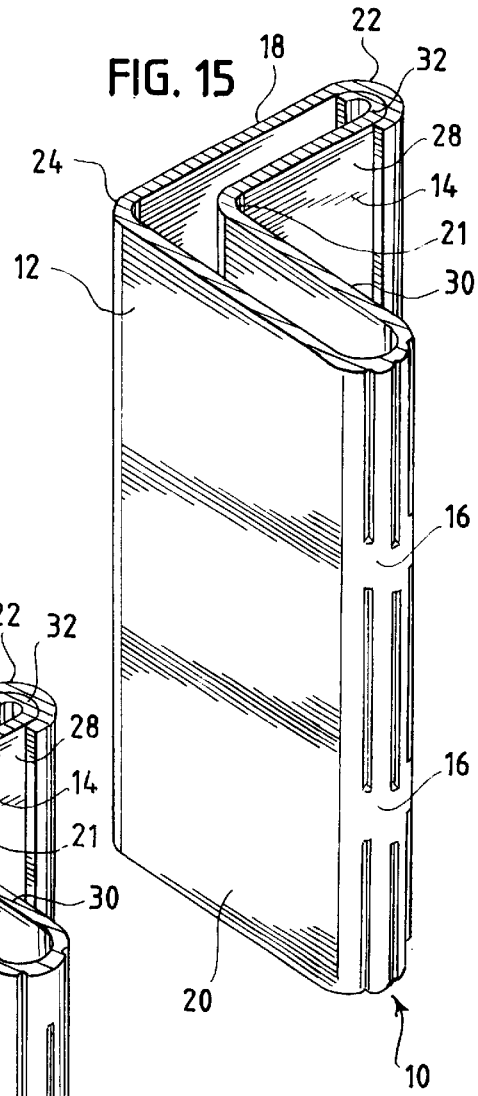
FIG. 15 is a perspective view of a protective post according to the present invention having a hinged area having uncreased horizontal sections disposed between score lines.
Figure 14:
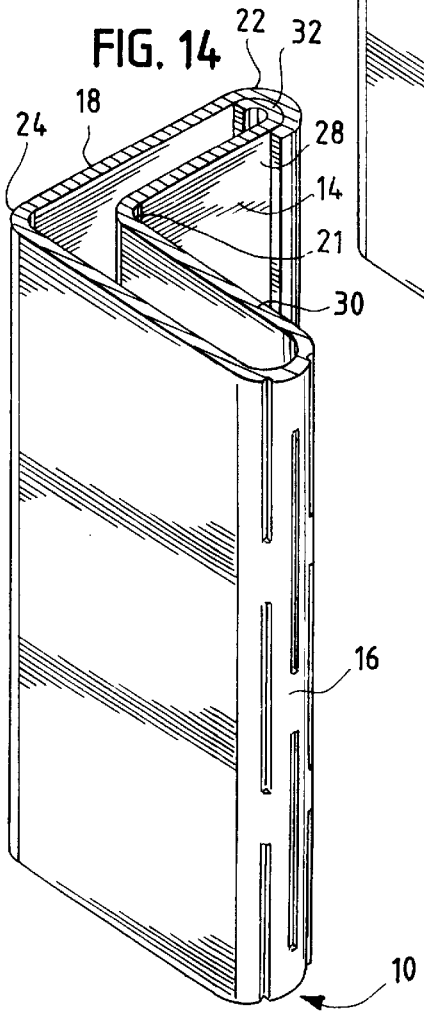
FIG. 14 is a perspective view of a protective post according to the present invention having staggered score lines along the hinged area.

Instead of creases, the hinged area 16 may be slit scored, as shown in FIGS. 13–15. Scoring may be done on the exterior side of the hinged area, the interior side, or both.

Figure 4:
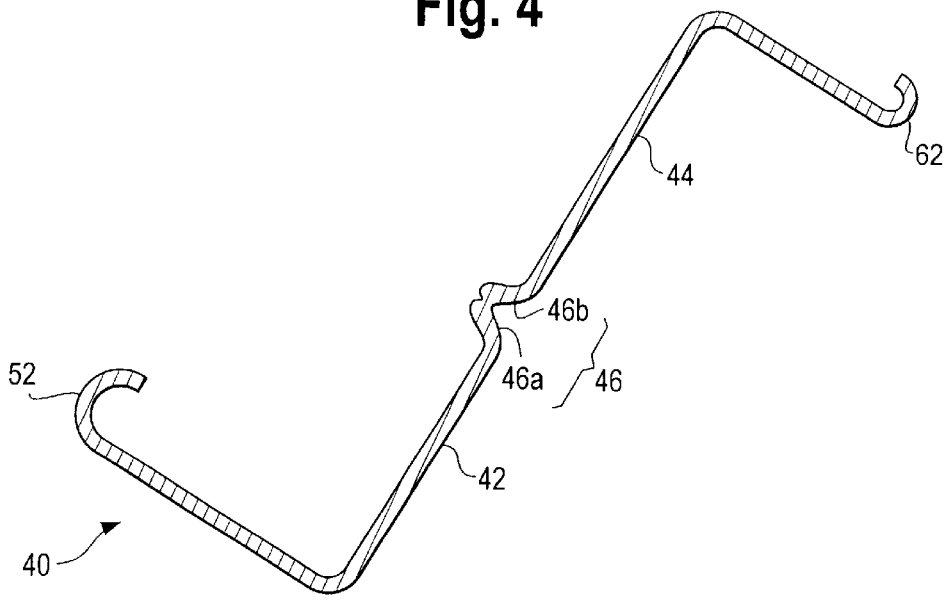
FIG. 4 is a top plan view of a second embodiment of a protective post according to the present invention in an unfolded position.

In the alternative embodiment shown in FIG. 4, instead of creases or score lines, the hinged area comprises a single V-shaped bend 46. The bend 46 is made during the process of forming the unfolded protective device 40 summarized below. Like the FIG. 1 embodiment, the protective device of FIG. 4 comprises an outer wall portion 42 and an inner wall portion 44 that fold together to form a substantially L-shaped post. Also like the FIG. 1 embodiment, each wall portion 42, 44 terminates in a hook or connecting portion 52, 62. When the wall portions 42, 44 are brought together, the end portions 52, 62 cooperate to form a close fit. The end portions may be configured such that they form a snap fit, or may be joined by adhesive, staples, stitches or any other suitable means to form the finished protective device.

Preferably, the hinged area 46 comprises two mirror-image opposing curved areas 46*a*, 46*b* as shown in FIG. 4. Each curved area 46*a*, 46*b* is preformed in linear fashion by being pressed into a shallow mandrel to define an arc of about ninety degrees. When the walls 42, 44 are brought into alignment, the curved areas 46*a*, 46*b* form a relatively smooth 180 degree curve.

The protective device may be made in the following manner. First, using a linear type drawing apparatus, a substantially rectangular sheet is made comprising multiple plies of paper or paperboard laminated together. The plies may be made from different types of paperboard and/or may be oriented in different directions. Next, while the laminate is still wet, the sheet is formed into a semi-profiled nestable type shape as shown in FIGS. 1 and 4 using a forming apparatus. Rollers or bars on either side of the linear drawing apparatus can be used to shape the hooks or connecting portions. For the creased structure shown in FIG. 1, an additional creasing step may be required. If the hinged area is scored, a scoring step is required. After drying, the semi-profiled nestable type structure is shipped to a customer who then folds the device and joins the connecting portions before use.

Conventional wound tubular protective devices are made by winding a continuous roll of paperboard around an L-shaped mandrel. Forming mandrels under hydraulic pressure then press the wound paper against the L-shaped mandrel while the laminate is drying. Because a continuous roll of paperboard is used, the finished product is made of only one type of paper.

By contrast, the present invention is made from multiple plies of paperboard stacked and laminated together. The invention can be made using more than one type of ply and/or different ply sizes and ply orientations to suit individual applications and conditions. If desired, the plies may be cross-laminated (i.e. the lamination applied in different directions).

Figure 5:
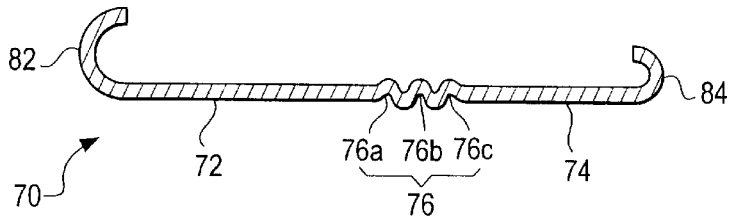
FIG. 5 is top plan view of a third embodiment of a protective post according to the present invention in an unfolded position.
Figure 6:
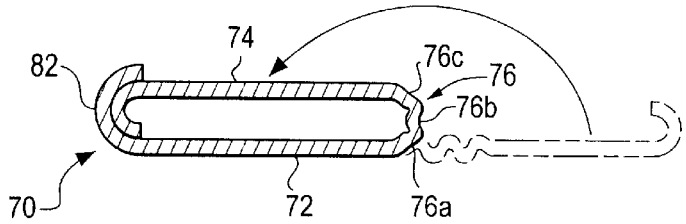
FIG. 6 is a top plan view of the protective post of FIG. 5 after it has been folded into shape.

FIGS. 5 and 6 show another embodiment of the present invention wherein the folded protective device 70 is linear or I-shaped to fit flush between planar surfaces, such as the side of an appliance and the inside wall of a package or carton. The device 70 is best used to cushion and protect a packaged product by placing it between the product and the inside wall of the package about halfway between adjoining corners.

The I-shaped protective device 70 comprises a first wall portion 72 and a second wall portion 74 connected by a hinged area 76. In the embodiment shown in FIGS. 5 and 6, the hinged area 76 comprises three creases 76*a*, 76*b*, 76*c*, but any suitable number of creases and/or scores may be used.

Like the previous embodiments, each wall portion 72, 74 terminates in a hook or connecting portion 82, 84. When the wall portions 72, 74 are brought together, the connecting portions 82, 84 cooperate to form a close fit. The connecting portions may be joined by adhesive, staples, stitches or any other suitable means.

Figure 7:
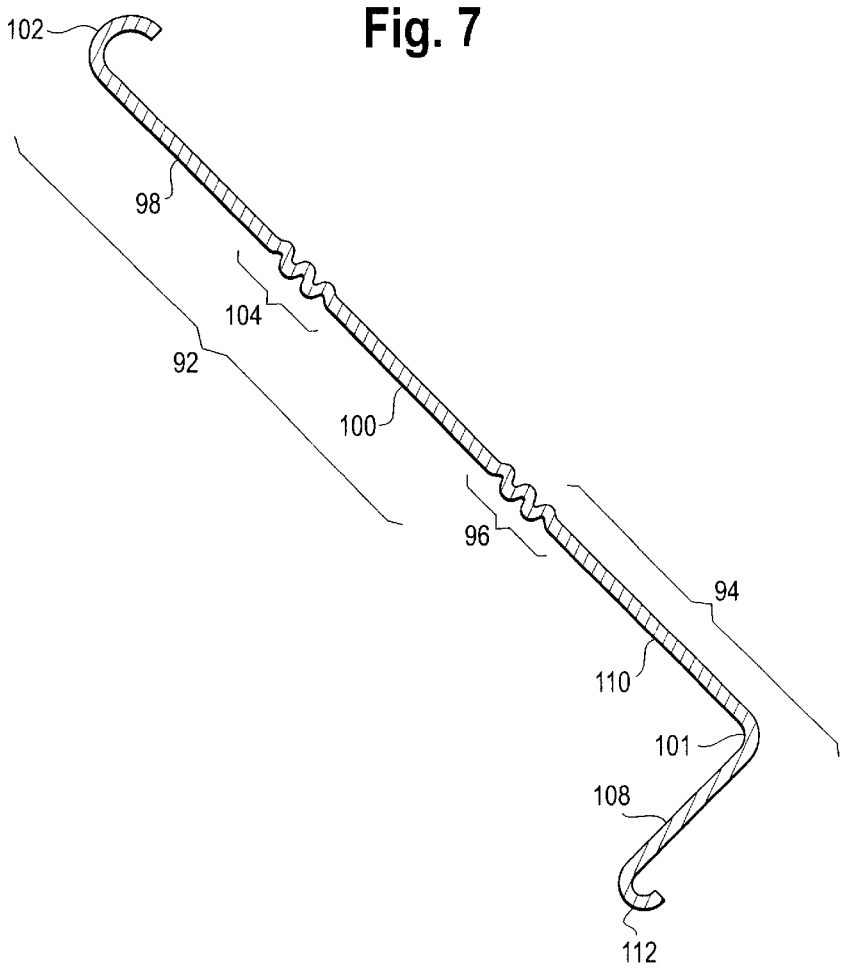
FIG. 7 is a top plan view of a fourth embodiment of a protective post according to the present invention in an unfolded position.
Figure 8:
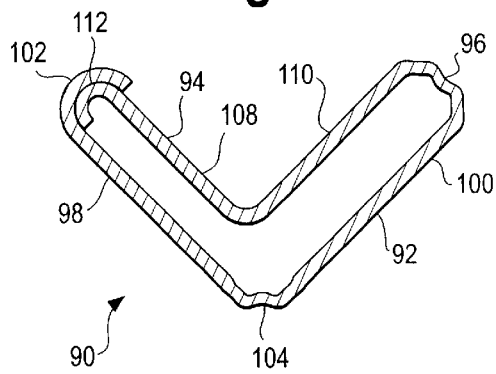
FIG. 8 is a top plan view of the protective post of FIG. 7 after it has been folded into shape.

FIGS. 7 and 8 show another embodiment of the present invention, one that folds to become a substantially L-shaped protective device. The protective device 90 comprises an outer wall portion 92 and an inner wall portion 14 connected by a hinged area 96. One or both of the wall portions 92, 94 can be rotated with respect to the hinged area 96 to form the hollow L-shaped tube 90 shown in FIG. 8.

Unlike the embodiment shown in FIG. 1, this embodiment has a second hinged area located at the outer wall apex 104. Prior to folding, the outer wall portion 92 is substantially linear, not L-shaped, and comprises first and second legs 98, 100 connected at the hinged outer wall apex 104. The first leg 98 terminates in a hook or connecting portion 102. The second leg 100 terminates at the hinged area 96.

The inner wall portion 94 is substantially L-shaped and comprises first and second legs 108, 110 connected along an inner corner 101. The first leg 108 extends away from the inner corner 101 and terminates in a hook or connecting portion 112. The second leg 110 extends away from the inner corner 101 and terminates at the hinged area 96.

To form the finished device 90, the first and second outer wall legs 98, 100 are brought into perpendicular alignment by rotating the first leg 98 clockwise (when viewed from the top) about the hinged apex area 104. The inner wall portion 94 is rotated counterclockwise around the hinged area 96 until the first inner leg 108 is parallel to the first outer leg 98 and the second inner leg 110 is parallel to the second outer leg 100. The result is the tubular corner post 90 of FIG. 8. The connecting portions 102, 112 cooperate to form a close fit that may be glued, stapled, stitched or otherwise joined.

Figure 9:
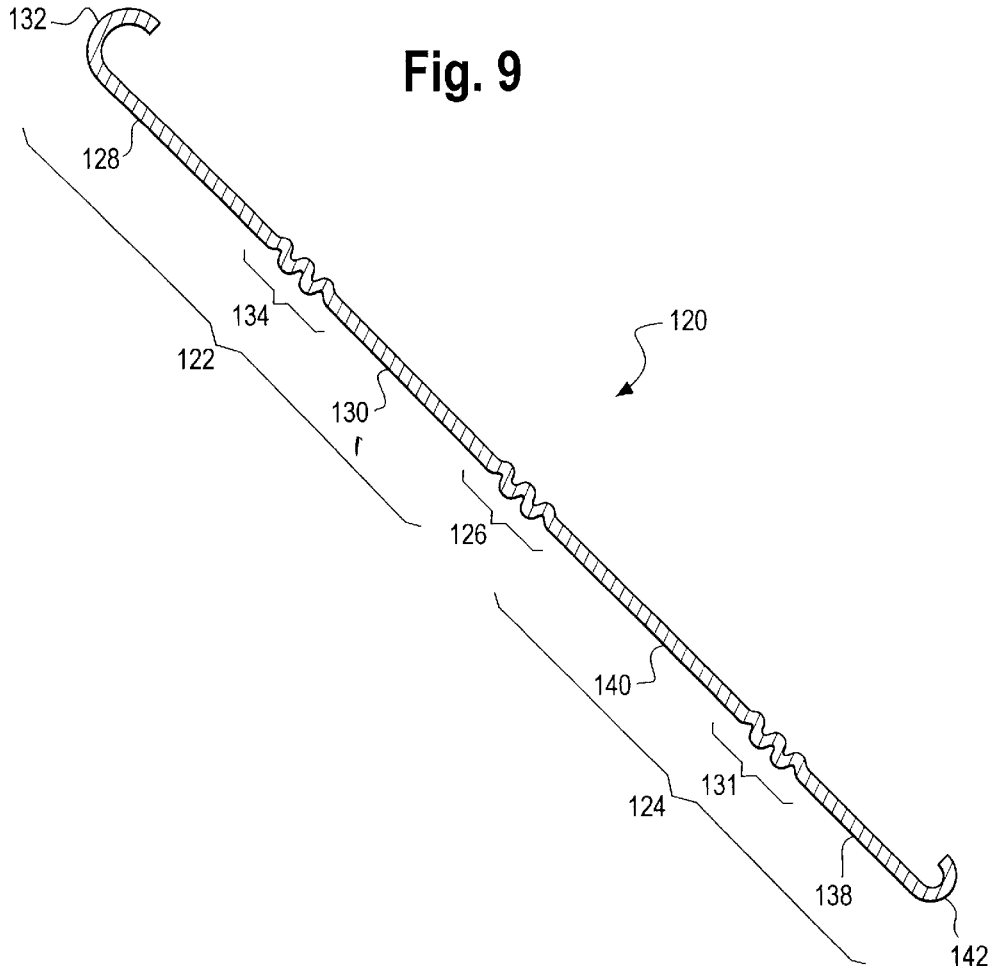
FIG. 9 is a top plan view of a fifth embodiment of a protective post according to the present invention in an unfolded position.
Figure 10:
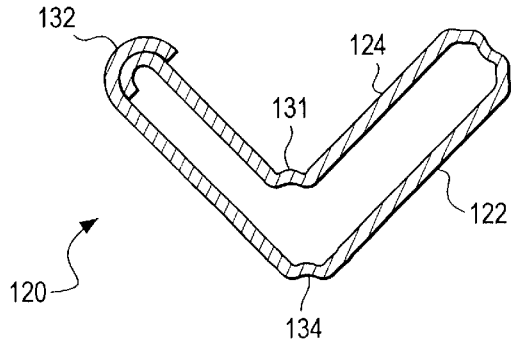
FIG. 10 is a top plan view of the protective post of FIG. 9 after it has been folded into shape.

FIGS. 9 and 10 show still another embodiment of a single piece fold-to-shape protective device 120 made according to the present invention. The protective device 120 comprises an outer wall portion 122 and an inner wall portion 124 connected by a hinged area 126. This embodiment has three hinged areas, including hinged areas at both the outer wall apex 134 and the inner wall corner 131.

The outer wall portion 122 is substantially linear and comprises first and second legs 128, 130 connected at the hinged outer wall apex 134. The first leg 128 extends away from the hinged apex 134 terminates in a hook or connecting portion 132. The second leg 130 extends away from the hinged apex 134 and terminates at the hinged area 126.

The inner wall portion 124 is also substantially linear, and comprises first and second legs 138, 140 connected along an inner corner hinged area 131. The first leg 138 extends away from the hinged inner corner 131 and terminates in a hook or connecting portion 142. The second leg 140 extends away from the hinged inner corner 131 and terminates at the hinged area 126.

To form the finished device 132 shown in FIG. 10, the inner wall first leg 138 is rotated clockwise around the hinged inner corner 131 until it is substantially perpendicular to the inner wall second leg 140. (After this rotation the device 120 will have a shape similar to that shown in FIG. 7.) The outer wall first leg 128 is then rotated clockwise around the hinged apex 134 until it is substantially perpendicular to the outer wall second leg 130. (After this second rotation the device 120 will have a shape similar to that shown in FIG. 1.) Finally, the now L-shaped inner wall portion 124 is rotated counterclockwise around the hinged area 126 until the first inner leg 138 is parallel to the first outer leg 128 and the second inner leg 140 is parallel to the second outer leg 130. The result is the tubular corner post 120 of FIG. 10. When the protective device of FIG. 9 is folded into an L-shape, the end portions 132, 142 cooperate to form a close fit that may be glued, stapled, stitched or otherwise secured.

Thus has been provided a single piece protective device that can be stacked or nested in an unfolded position and then folded into the desired shape when ready for use. The device is made from a substantially rectangular sheet of laminated paperboard comprising an outer wall and an inner wall connected by a hinged area running longitudinally from top to the bottom. The hinged area comprises a plurality of longitudinal creases or scores. The sheet is made of multiple plies of material laminated together. The plies can be made from different types of materials, and may be oriented in different directions to achieve desired structural properties.

Other modifications and alternative embodiments are contemplated which do not depart from the spirit and scope of the invention as defined by the foregoing teachings and appended claims. For example, beads or grooves may be formed in the walls of the protective device to increase strength. It is intended that the claims cover all such modifications that fall within their scope.

I claim as my invention:

1. A substantially rectangular sheet of laminated paperboard that can be folded into an elongated, hollow device for protecting a packaged article, said sheet comprising:

a top and a bottom;

a hinged area running longitudinally from the top of the sheet to the bottom;

an outer wall portion extending from the hinged area and terminating in an outer wall connecting portion;

an inner wall portion extending from the hinged area away from the outer wall portion and terminating in an inner wall connecting portion; and means for joining the outer and inner wall connecting portions;

wherein, when the rectangular sheet is folded the outer and inner walls are substantially parallel and form a hollow tube, and wherein multiple protective devices can be nested in an unfolded position.

2. The sheet of claim 1 wherein the hinged area comprises a plurality of longitudinal creases.

3. The sheet of claim 2 wherein each crease extends the entire height of the sheet.

4. The sheet of claim 2 wherein the creases extend less than the entire height of the sheet and are staggered.

5. The sheet of claim 4 wherein the staggered creases overlap in a horizontal plane.

6. The sheet of claim 4 wherein the hinged area comprises smooth, uncreased horizontal sections disposed between the creases.

7. The sheet of claim 1 wherein the paper fibers run substantially longitudinally.

8. The sheet of claim 1 wherein the hinged area comprises a plurality of longitudinal scores.

9. The sheet of claim 8 wherein each score line extends the entire height of the sheet.

10. The sheet of claim 8 wherein the scores extend less than the entire height of the sheet and are staggered.

11. The sheet of claim 10 wherein the staggered scores overlap in a horizontal plane.

12. The sheet of claim 10 wherein the hinged area comprises smooth, unscored horizontal sections disposed between the staggered scores.

13. The sheet of claim 1 wherein, when the sheet is folded into a tube, the outer and inner wall connecting portions are glued together.

14. The sheet of claim 1 wherein the sheet comprises multiple plies of different types of paper.

15. The sheet of claim 1 wherein the sheet comprises multiple plies of paper oriented in different directions.

16. The sheet of claim 1 wherein the sheet is cross-laminated.

17. The sheet of claim 1 wherein the outer and inner wall portions are substantially L-shaped and the protective device is substantially L-shaped.

18. The sheet of claim 1 wherein the outer and inner walls are substantially I-shaped and the protective device is substantially I-shaped.

19. The sheet of claim 1 wherein the hinged area comprises a V-shaped bend, said bend comprising two mirror-image opposing curved areas.

20. The sheet of claim 19 wherein each curved area defines an arc of about ninety degrees such that, when the sheet is folded into the protective device, the curved areas form a 180 degree curve.

21. The sheet of claim 1 wherein the outer wall portion further comprises first and second legs connected by a hinged apex, said first outer wall leg extending from the hinged apex and terminating in the outer wall curved edge, said second outer wall leg extending from the hinged apex and terminating at the hinged area.

22. The sheet of claim 21 wherein the inner wall portion further comprises first and second legs connected at a hinged inner corner, said first inner wall leg extending away from the hinged inner corner and terminating in the inner wall curved edge, said second inner wall leg extending from the inner corner and terminating at the hinged area.

23. A substantially rectangular sheet of laminated paperboard that can be folded into an elongated, hollow, L-shaped protective device, said sheet comprising:

an outer wall first leg;

an outer wall second leg extending at substantially a right angle to the outer wall first leg and terminating in a hinged area;

an inner wall second leg extending from the hinged area in substantially the same plane as the outer wall second leg; and an inner wall first leg extending at substantially a right angle to the inner wall second leg;

said outer and inner wall first legs having curved ends that form a close fit when the sheet is folded into the elongated, hollow, L-shaped protective device.

24. The sheet of claim 23 wherein the hinged area comprises a plurality of creases.

* * * * *